US008180268B2

(12) United States Patent
Ruiz et al.

(10) Patent No.: US 8,180,268 B2
(45) Date of Patent: May 15, 2012

(54) METHOD AND APPARATUS FOR AUTOMATIC FUSER WEB MATERIAL ADVANCEMENT IN AN IMAGE PRODUCTION UNIT

(75) Inventors: Erwin Ruiz, Rochester, NY (US); David Lalley, Webster, NY (US); Gregory P. Miller, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 1036 days.

(21) Appl. No.: 12/120,272

(22) Filed: May 14, 2008

(65) Prior Publication Data

US 2009/0285608 A1 Nov. 19, 2009

(51) Int. Cl.
*G03G 15/20* (2006.01)

(52) U.S. Cl. ..... 399/327

(58) Field of Classification Search ..... 399/327, 399/324, 325

See application file for complete search history.

(56) References Cited

U.S. PATENT DOCUMENTS

| | | | | |
|---|---|---|---|---|
| 6,223,005 | B1 * | 4/2001 | Rush et al. | 399/45 |
| 6,347,197 | B1 * | 2/2002 | Maul et al. | 399/24 |
| 6,532,353 | B1 * | 3/2003 | Orchard et al. | 399/327 |
| 6,704,526 | B2 * | 3/2004 | Nakamura | 399/327 |
| 7,263,322 | B2 * | 8/2007 | Pino et al. | 399/325 |
| 7,715,773 | B2 * | 5/2010 | Ide et al. | 399/327 |
| 2002/0154926 | A1 * | 10/2002 | Katoh | 399/327 |
| 2009/0196642 | A1 * | 8/2009 | Condello | |

* cited by examiner

*Primary Examiner* — Susan Lee

(74) *Attorney, Agent, or Firm* — Ronald E. Prass, Jr.; Prass LLP

(57) ABSTRACT

A method and apparatus that automatically advances fuser web material in an image production unit is disclosed. The method may include receiving a signal to advance fuser web material, retrieving stored fuser web material position information, automatically advancing the fuser web material a predetermined amount to expose unused fuser web material, and storing updated fuser web material position information.

17 Claims, 6 Drawing Sheets

METHOD AND APPARATUS FOR AUTOMATIC FUSER WEB MATERIAL ADVANCEMENT IN AN IMAGE PRODUCTION UNIT

BACKGROUND

Disclosed herein are a method for automatic fuser web material advancement, as well as corresponding apparatus and computer-readable medium.

Most of the xerographic image production units require cleaning devices, such as a fuser web cassette, in order to remove the non-fused toner from fuser rolls. The fuser web material will also collect contamination from offset printing originals. Fuser roll contamination or excess of non fused toner is image dependant. For some products, half-tone documents generate significant contamination. This excessive contamination will saturate the fuser web material.

In other scenarios, the fuser web material may be overheated by fuser roll temperature overshoot, showing a localized burn like appearance. This burn like material could affect the fuser web cleaning function.

During fuser module trouble shooting process, the technicians will inspect the fuser web cassette for appearance and performance. In some situations, the fuser web material could be saturated with non-fused toner, offset printing ink, or will have a burn like appearance. This fuser web material appearance could mislead the technician to believe that there is a malfunction with the fuser web performance. Not having a technique to advance the fuser web material in order to obtain a fresh material could prompt the technician to replace the fuser web assembly. At a significant per item cost, this early fuser web cassette replacement could prevent maximizing the use of the fuser web cassette and increase overall machine operating cost.

Some technicians may try to advance the fuser web material manually. However, this action is difficult to achieve due to a high-driving torque. In addition, movement of the web manually will likely create an error in fuser web cassette counter. Furthermore, movement of the web in the wrong direction will likely create a potential multi-wrap failure.

SUMMARY

A method and apparatus that automatically advances fuser web material in an image production unit is disclosed. The method may include receiving a signal to advance fuser web material, retrieving stored fuser web material position information, automatically advancing the fuser web material a predetermined amount to expose unused fuser web material, and storing updated fuser web material position information.

DETAILED DESCRIPTION

Figure 1:
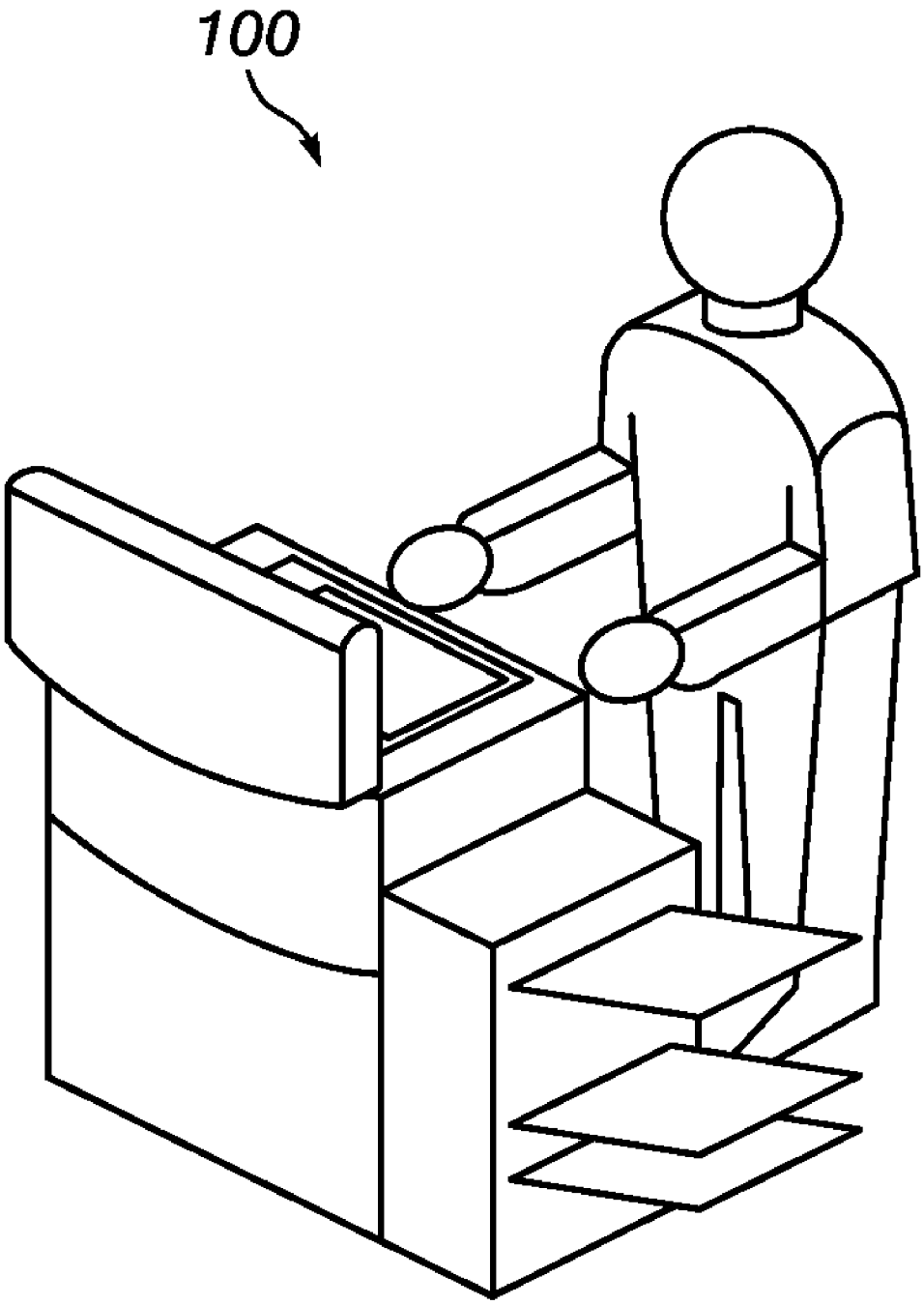
FIG. 1 illustrates an exemplary diagram of an image production unit in accordance with one possible embodiment of the disclosure.

Aspects of the embodiments disclosed herein relate to a method for automatic fuser web material advancement, as well as corresponding apparatus and computer-readable medium.

The disclosed embodiments may include a method for automatically advancing fuser web material in an image production unit. The method may include receiving a signal to advance fuser web material, retrieving stored fuser web material position information, automatically advancing the fuser web material a predetermined amount to expose unused fuser web material, and storing updated fuser web material position information.

The disclosed embodiments further include an apparatus that automatically advances a fuser web material in an image production unit. The apparatus may include a memory, a fuser web cassette containing fuser web material, and a fuser web material advancement module that receives a signal to advance the fuser web material, retrieves stored fuser web material position information from the memory, automatically advances the fuser web material a predetermined amount to expose unused fuser web material, and stores updated fuser web material position information in the memory.

The disclosed embodiments further include a computer-readable medium that stores instructions for controlling a computing device for automatically advances fuser web material in an image production unit. The instructions may include receiving a signal to advance fuser web material, retrieving stored fuser web material position information, automatically advancing the fuser web material a predetermined amount to expose unused fuser web material, and storing updated fuser web material position information.

This disclosure may concern a process of advancing fuser web material in an image production unit using software under service diagnostics in order to provide fresh fuser web material. The disclosure may also concern a process that may increase the web assembly drive motor speed for a short period of time in order to provide a clean fuser web area.

In this manner, during a fuser service call, for example, the service technician (CSE) may inspect the fuser web cassette for contamination or potential fuser web material damage. If the fuser web material has excessive contamination or burn like appearance or any other degradation like appearance, the CSE may enter into component control, for example, and may run a fuser web material advancement process. The fuser web advancement process may provide clean fuser web material and may adjust the high service frequency items (HSFI) service interval value accordingly.

Advantages of this process may include 1) that the fuser web advancement process may provide fresh clean fuser web material which will help avoid potential stalling, image quality (IQ) issues, or fuser roll damage due to excessive build up of toner on the fuser web material; 2) that there is no need for the CSE to advance the fuser web material manually which could damage the integrity of the assembly performance; 3) that the HSFI counter will be adjusted automatically; and 4) that the CSE does not needlessly replace the fuser web cassette which will ultimately save time and money.

FIG. 1 illustrates an exemplary diagram of an image production unit 100 in accordance with one possible embodiment of the disclosure. The image production unit 100 may be any device that may be capable of making copies including a copier, a printer, an office copier, a high-capacity copier, a commercial copier, a facsimile device, and a multi-function device (MFD), for example.

Figure 2:
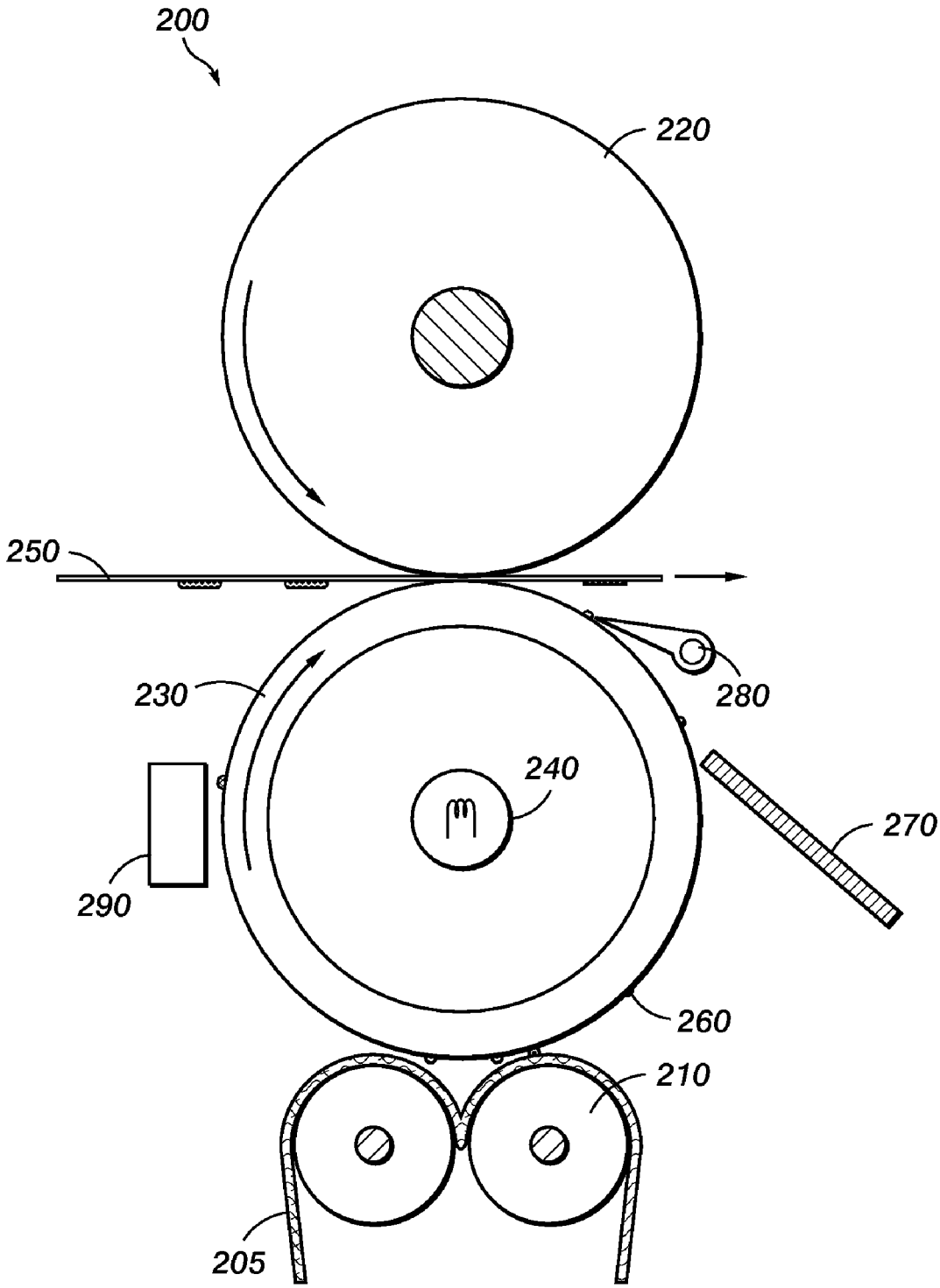
FIG. 2 illustrates a diagram of a fuser web environment in accordance with one possible embodiment of the disclosure.

FIG. 2 illustrates a diagram of a fuser web environment 200 in accordance with one possible embodiment of the disclosure. The fuser web environment 200 may include fuser web material 205, fuser web cartridge 210, pressure roll 220, fuser roll 230, heating lamp 240, print media 250, unused toner 260, non-retracting baffle 270, stripper fingers 280, and thermistor 290. When processing print media 250, unused toner 260 may accumulate on components of the fuser area, including the pressure roll 220, the fuser roll 230, the heating lamp 240, the non-retracting baffle 270, the stripper fingers 280, and the thermistor 290. The fuser web cartridge 210 may contain fuser web material 205 which is used to clean unused toner 260 from these components to help avoid potential stalling, IQ issues, or fuser roll damage.

Figure 3:
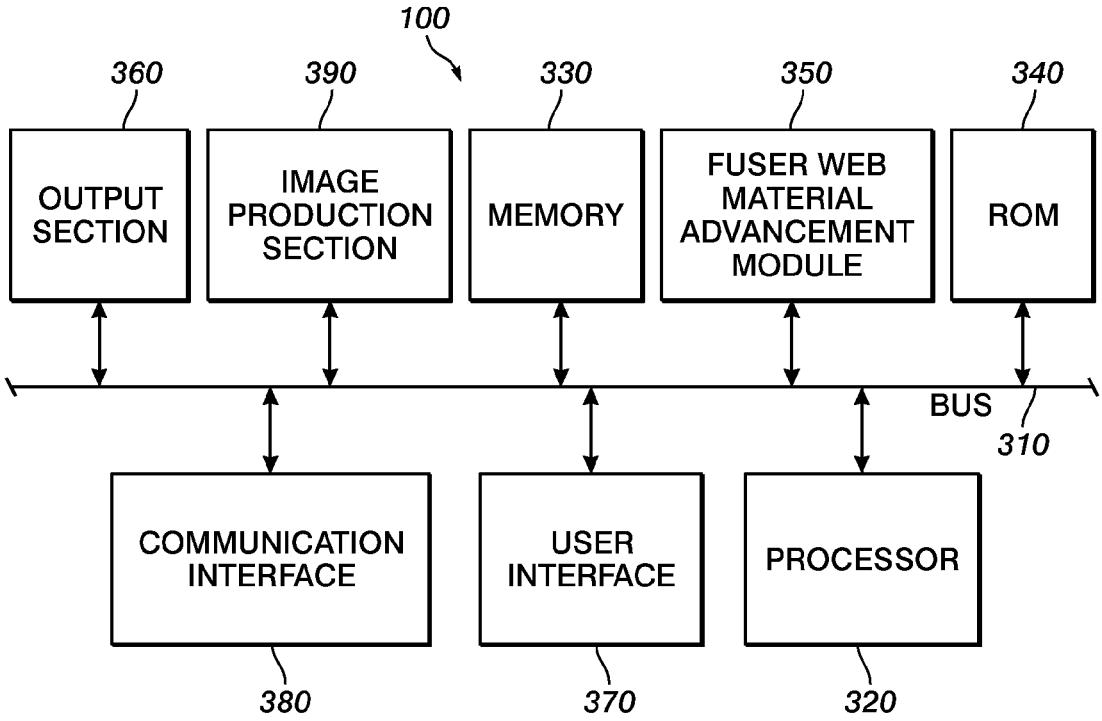
FIG. 3 illustrates a block diagram of an image production unit in accordance with one possible embodiment of the disclosure.

FIG. 3 illustrates a block diagram of an image production unit 100 in accordance with one possible embodiment of the disclosure. The image production unit 100 may include may include a bus 310, a processor 320, a memory 330, a read only memory ROM 340, a fuser web material advancement module 350, an output section 360, a user interface 370, a communication interface 380, and an image production section 390. Bus 310 may permit communication among the components of the image production unit 100.

Processor 320 may include at least one conventional processor or microprocessor that interprets and executes instructions. Memory 330 may be a random access memory (RAM) or another type of dynamic storage device that stores information and instructions for execution by processor 320. Memory 330 may also include a read-only memory ROM) which may include a conventional ROM device or another type of static storage device that stores static information and instructions for processor 320.

Communication interface 380 may include any mechanism that facilitates communication via a network. For example, communication interface 380 may include a modem. Alternatively, communication interface 380 may include other mechanisms for assisting in communications with other devices and/or systems.

ROM 340 may include a conventional ROM device or another type of static storage device that stores static information and instructions for processor 320. A storage device may augment the ROM and may include any type of storage media, such as, for example, magnetic or optical recording media and its corresponding drive.

User interface 370 may include one or more conventional mechanisms that permit a user to input information to and interact with the image production unit 100, such as a keyboard, a display, a mouse, a pen, a voice recognition device, touchpad, buttons, etc., for example. Output section 360 may include one or more conventional mechanisms that output documents to the user, including output trays, output paths, finishing section, etc., for example. The image processing section 390 may include an image printing section, a scanner, a fuser, etc., for example.

The image production unit 100 may perform such functions in response to processor 320 by executing sequences of instructions contained in a computer-readable medium, such as, for example, memory 330. Such instructions may be read into memory 330 from another computer-readable medium, such as a storage device or from a separate device via communication interface 380.

The image production unit 100 illustrated in FIGS. 1 and 2 and the related discussion are intended to provide a brief, general description of a suitable communication and processing environment in which the invention may be implemented. Although not required, the invention will be described, at least in part, in the general context of computer-executable instructions, such as program modules, being executed by the image production unit 100, such as a communication server, communications switch, communications router, or general purpose computer, for example.

Generally, program modules include routine programs, objects, components, data structures, etc. that perform particular tasks or implement particular abstract data types. Moreover, those skilled in the art will appreciate that other embodiments of the invention may be practiced in communication network environments with many types of communication equipment and computer system configurations, including personal computers, hand-held devices, multi-processor systems, microprocessor-based or programmable consumer electronics, and the like.

Figure 4:
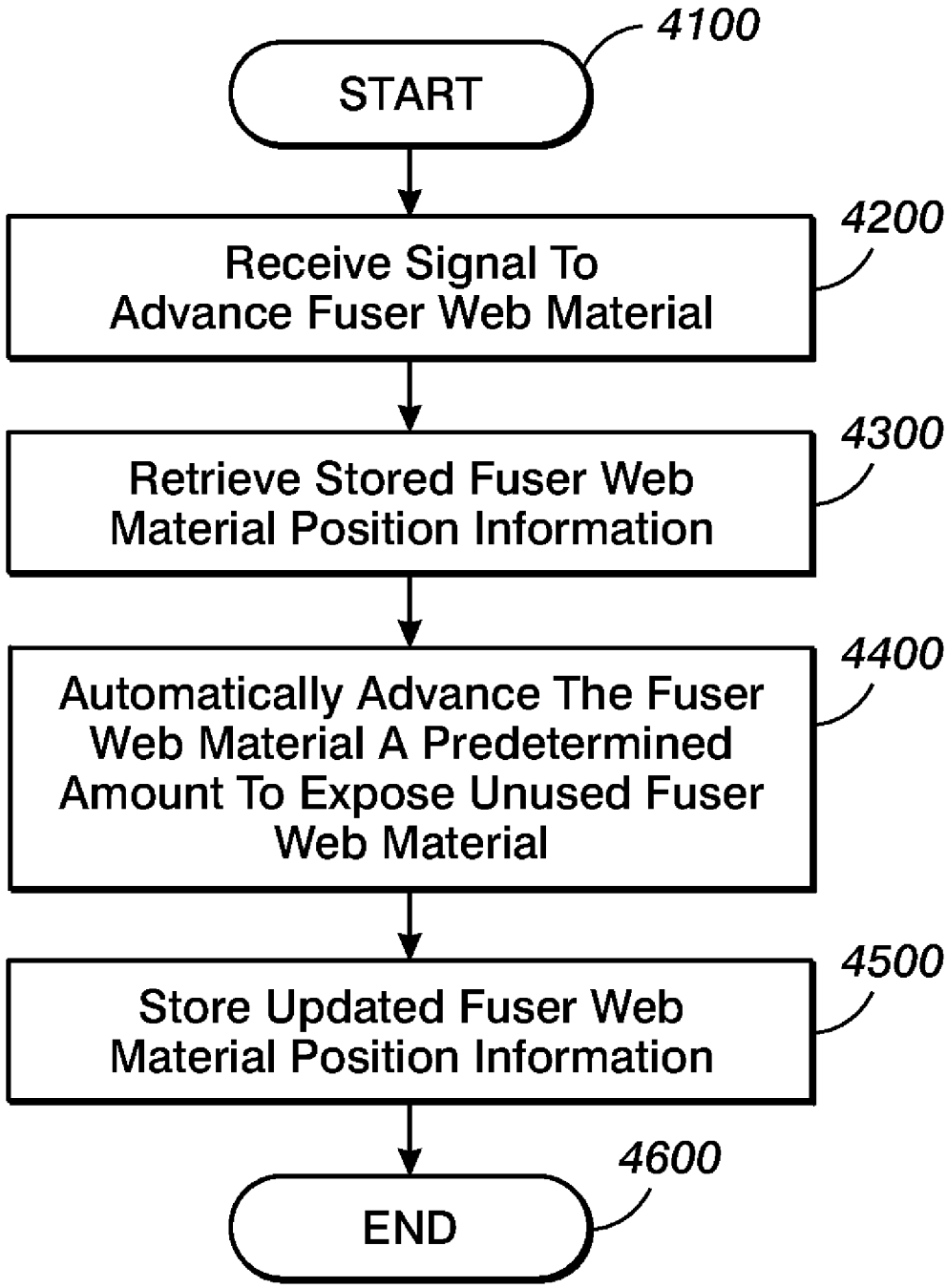
FIG. 4 is a flowchart of an exemplary automatic fuser web material advancement process in accordance with one possible embodiment of the disclosure.

For illustrative purposes, the operation of the fuser web material advancement module 350 and the exemplary fuser web material advancement process are described in FIG. 4 in relation to the block diagrams shown in FIGS. 1-3.

FIG. 4 is a flowchart of an exemplary fuser web material advancement process in accordance with one possible embodiment of the disclosure. The method begins at 4100, and continues to 4200 where the fuser web material advancement module 250 receives a signal to advance the fuser web material 205. The received signal to automatically advance the fuser web material 205 may be sent as a result of a technician's input at the user interface 370, for example. The fuser web material advancement module 250 may determine that the fuser web material 205 needs to be advanced without a technician's intervention. In this manner, the fuser web material advancement module 250 may determine that the fuser web material 205 is to be advanced based on any known criteria, including a number of copies made, time from last fuser web material advance, and a sensing of fuser web material contamination, for example.

At step 4300, the fuser web material advancement module 350 may retrieve stored fuser web material position information from the memory 330. The position information may be stored in any form that allows the fuser web material advancement module 250 to be able to determine the position of the fuser web material 205 at a given time.

At step 4400, the fuser web material advancement module 250 may automatically advance the fuser web material 205 a predetermined amount to expose unused fuser web material 205. This process may be done without either manual fuser web material advancement or fuser web cassette replacement by a technician. The predetermined amount for advancement may be determined by any known method including by a technician servicing the image production unit 100 at a user interface or by a manufacturer of the image production unit 100 having the predetermined amount stored in memory. The fuser web material advancement module 350 may also automatically adjust a high service frequency items interval counter to indicate that the fuser web material 205 was replaced.

At step 4500, the fuser web material advancement module 350 may store updated fuser web material position information in the memory 330. The process then goes to step 4600, and ends.

Figure 5A:
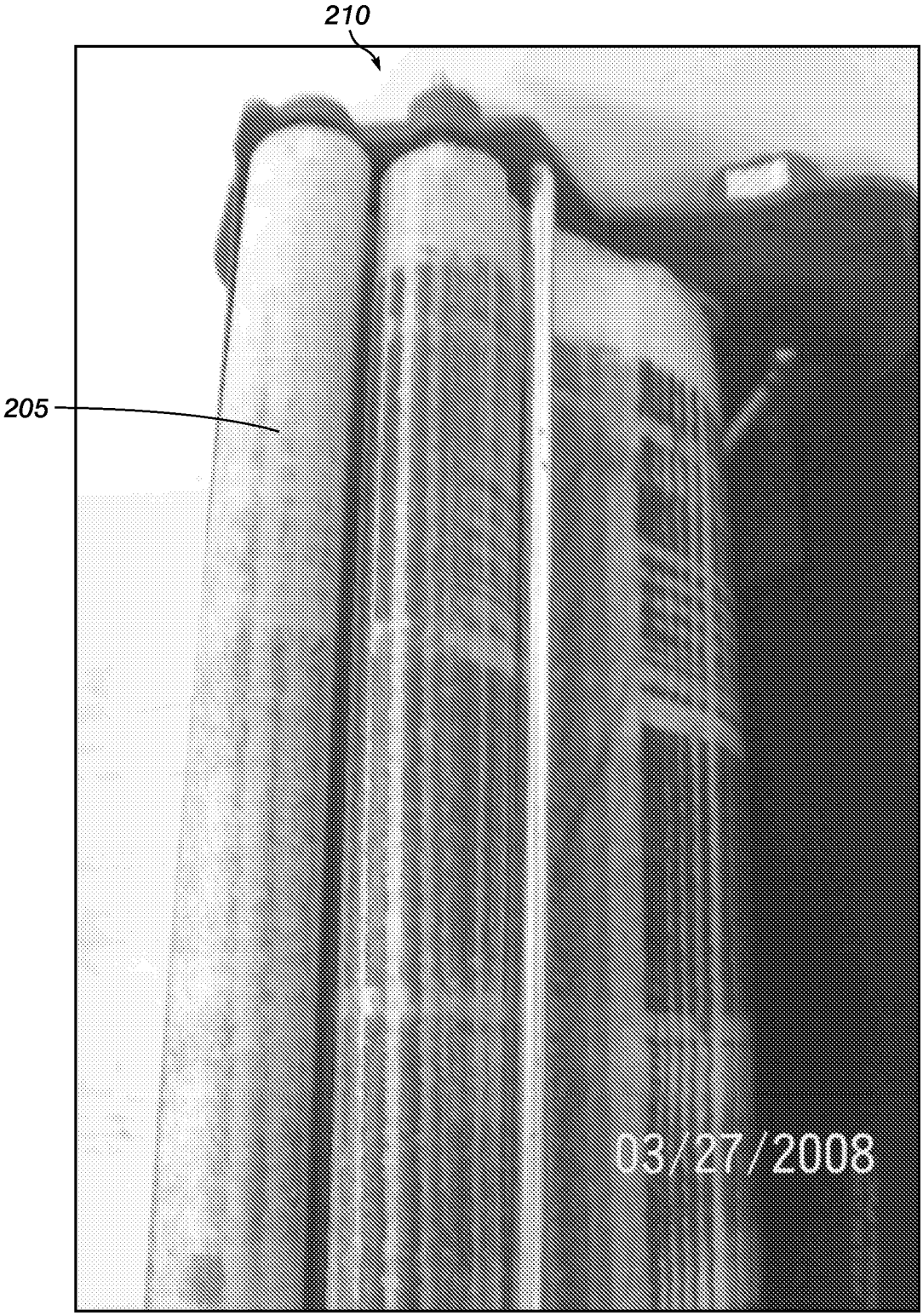
FIGS. 5A-5B illustrate exemplary fuser web cartridges before and after the automatic fuser web advancement process is applied in accordance with one possible embodiment of the disclosure.
Figure 5B:
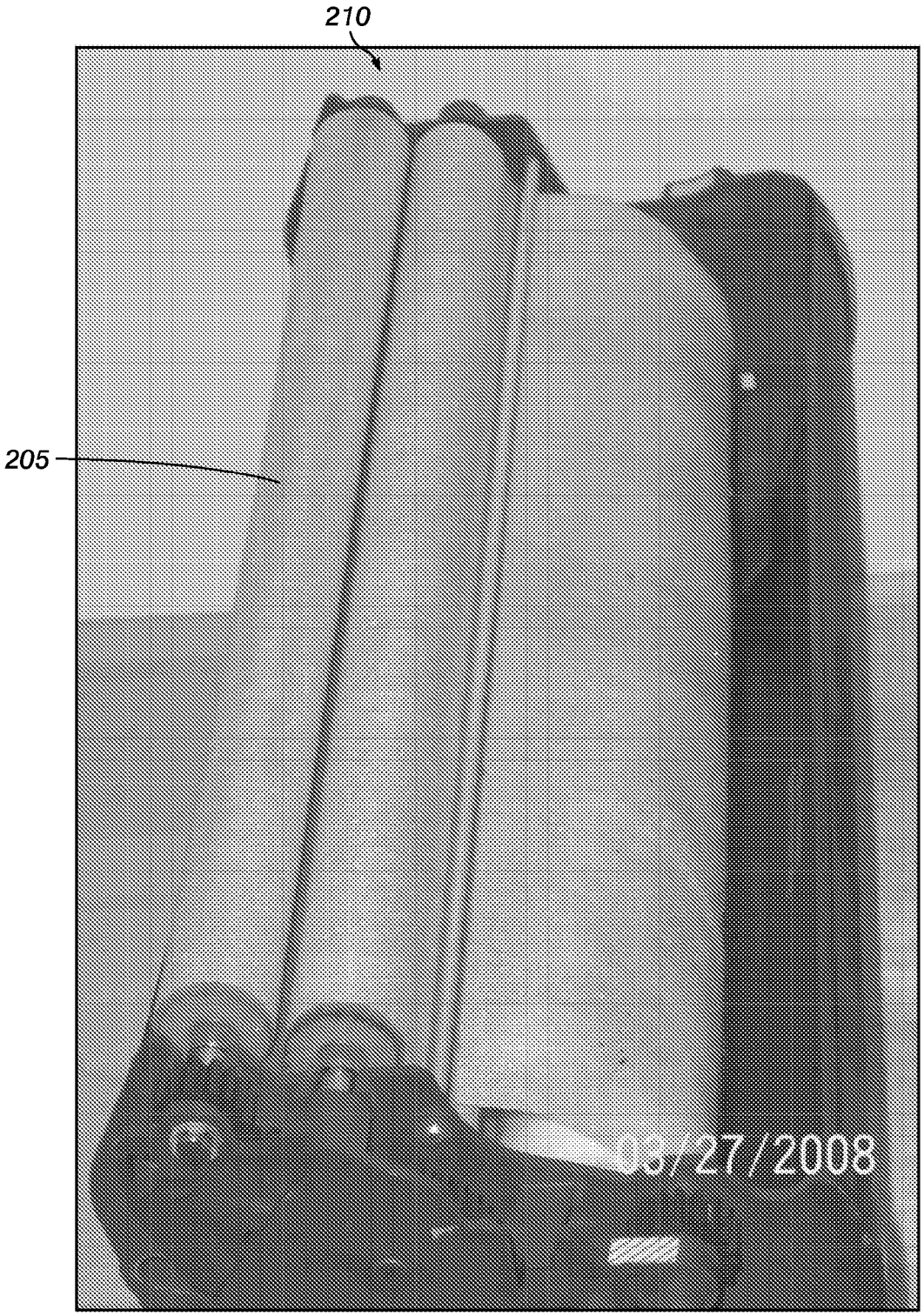

FIGS. 5A-5B illustrate exemplary fuser web cartridges 210 before and after the automatic fuser web advancement process is applied in accordance with one possible embodiment of the disclosure. FIG. 5A shows a fuser web cartridge 210 with fuser web material 205 that has been contaminated by unused toner 260. FIG. 5B shows the fuser web cartridge 210 with clean fuser web material 205 that has been advance by the fuser web material advancement process of the invention.

Embodiments as disclosed herein may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hard-wired, wireless, or combination thereof to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein. It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method for automatic fuser web material advancement in an image production unit, comprising:

receiving a signal to advance fuser web material;

retrieving stored fuser web material position information;

automatically advancing the fuser web material a predetermined amount to expose unused fuser web material; and storing updated fuser web material position information.

2. The method of claim 1, the predetermined amount is determined by one of a technician and a manufacturer of the image production unit.

3. The method of claim 1, further comprising:

determining that the fuser web material needs to be advanced.

4. The method of claim 1, wherein the received signal to automatically advance the fuser web material is sent as a result of a technician's input at a user interface.

5. The method of claim 1, wherein the image production unit is one of a copier, a printer, an office copier, a high-capacity copier, a commercial copier, a facsimile device, and a multi-function device.

6. An apparatus that automatically advances a fuser web material in an image production unit, comprising:

a memory;

a fuser web cassette containing fuser web material; and a fuser web material advancement module that receives a signal to advance the fuser web material, retrieves stored fuser web material position information from the memory, automatically advances the fuser web material a predetermined amount to expose unused fuser web material, and stores updated fuser web material position information in the memory.

7. The apparatus of claim 6, wherein the fuser web material advancement module automatically adjusts a high service frequency items interval counter.

8. The apparatus of claim 6, wherein the predetermined amount is determined by one of a technician and a manufacturer of the image production unit.

9. The apparatus of claim 6, wherein the fuser web material advancement module determines that the fuser web material needs to be advanced.

10. The apparatus of claim 9, wherein the fuser web material advancement module determines that the fuser web material is to be advanced based on one of a number of copies made, time from last fuser web material advance, and a sensing of fuser web material contamination.

11. The apparatus of claim 6, further comprising:

a user interface that sends a signal to automatically advance the fuser web material to the fuser web advancement module as a result of a technician's input.

12. The apparatus of claim 6, wherein the image production unit is one of a copier, a printer, an office copier, a high-capacity copier, a commercial copier, a facsimile device, and a multi-function device.

13. A computer-readable non-transitory medium storing instructions for controlling a computing device for automatic fuser web material advancement in an image production unit, the instructions comprising:

receiving a signal to advance fuser web material;

retrieving stored fuser web material position information;

automatically advancing the fuser web material a predetermined amount to expose unused fuser web material; and storing updated fuser web material position information.

14. The computer-readable non-transitory medium of claim 13, the predetermined amount is determined by one of a technician and a manufacturer of the image production unit.

15. The computer-readable non-transitory medium of claim 13, further comprising:

determining that the fuser web material needs to be advanced.

16. The computer-readable non-transitory medium of claim 13, wherein the received signal to automatically advance the fuser web material is sent as a result of a technician's input at a user interface.

17. The computer-readable non-transitory medium of claim 13, wherein the image production unit is one of a copier, a printer, an office copier, a high-capacity copier, a commercial copier, a facsimile device, and a multi-function device.

* * * * *